US010988819B2

(12) United States Patent
Yoshida et al.

(10) Patent No.: US 10,988,819 B2
(45) Date of Patent: Apr. 27, 2021

(54) HIGH-STRENGTH STEEL MATERIAL AND PRODUCTION METHOD THEREFOR

(71) Applicant: Nippon Steel & Sumitomo Metal Corporation, Tokyo (JP)

(72) Inventors: Shinji Yoshida, Tokyo (JP); Yuji Arai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 112 days.

(21) Appl. No.: 16/088,902

(22) PCT Filed: Mar. 15, 2017

(86) PCT No.: PCT/JP2017/010531

§ 371 (c)(1),
(2) Date: Sep. 27, 2018

(87) PCT Pub. No.: WO2017/169811

PCT Pub. Date: Oct. 5, 2017

(65) Prior Publication Data

US 2020/0123624 A1 Apr. 23, 2020

(30) Foreign Application Priority Data

Mar. 30, 2016 (JP) ..... JP2016-067741

(51) Int. Cl.
*C22C 38/02* (2006.01)
*C22C 38/06* (2006.01)
(Continued)

(52) U.S. Cl.
CPC ..... *C21D 8/005* (2013.01); *C21D 6/001* (2013.01); *C21D 6/002* (2013.01); *C21D 6/005* (2013.01);
(Continued)

(58) Field of Classification Search
CPC ..... C21D 8/005; C21D 6/001; C21D 6/002; C21D 6/005; C21D 6/008; C22C 38/001;
(Continued)

(56) References Cited

U.S. PATENT DOCUMENTS

2011/0308673 A1 12/2011 Schneider et al.
2012/0160363 A1 6/2012 Jin et al.
(Continued)

FOREIGN PATENT DOCUMENTS

CN 1295139 A 5/2001
CN 101307415 A 11/2008
(Continued)

OTHER PUBLICATIONS

Oct. 16, 2019 (CA) Office Action Application No. 3,019,483.
(Continued)

*Primary Examiner* — Brian D Walck
(74) *Attorney, Agent, or Firm* — Banner & Witcoff, Ltd.

(57) ABSTRACT

A high-strength steel material that has a chemical composition containing, by mass %, C: 0.30 to 1.0%, Si: 0.05 to 1.0%, Mn: 16.0 to 35.0%, P: 0.030% or less, S: 0.030% or less, Al: 0.003 to 0.06%, N: 0.1% or less, V: 0 to 3.0%, Ti: 0 to 1.5%, Nb: 0 to 1.5%, Cr: 0 to 5.0%, Mo: 0 to 3.0%, Cu: 0 to 1.0%, Ni: 0 to 1.0%, B: 0 to 0.02%, Zr: 0 to 0.5%, Ta: 0 to 0.5%, Ca: 0 to 0.005%, Mg: 0 to 0.005%, and the balance: Fe and impurities, and that satisfies [V+Ti+Nb>2.0], in which: a number density of carbides/carbonitrides having a circle-equivalent diameter of 5 to 30 nm precipitating in the steel is 50 to 700/μm$^2$, and a number density of carbides/carbo-nitrides having a circle-equivalent diameter of more than 100 nm precipitating in the steel is less than 10/μm$^2$; a yield stress is 758 MPa or more; and a $K_{ISSC}$ value obtained in a DCB test is 33.7 MPa·m$^{0.5}$ or more.

6 Claims, 2 Drawing Sheets

(51) Int. Cl.

| | |
|---|---|
| ***C22C 38/08*** | (2006.01) |
| ***C22C 38/14*** | (2006.01) |
| ***C22C 38/16*** | (2006.01) |
| ***C22C 38/24*** | (2006.01) |
| ***C22C 38/38*** | (2006.01) |
| ***C21D 8/00*** | (2006.01) |
| ***C21D 6/00*** | (2006.01) |
| ***C22C 38/00*** | (2006.01) |

(52) U.S. Cl.
CPC ..... *C21D 6/008* (2013.01); *C22C 38/001* (2013.01); *C22C 38/002* (2013.01); *C22C 38/02* (2013.01); *C22C 38/06* (2013.01); *C22C 38/08* (2013.01); *C22C 38/14* (2013.01); *C22C 38/16* (2013.01); *C22C 38/24* (2013.01); *C22C 38/38* (2013.01); *C21D 2211/004* (2013.01)

(58) Field of Classification Search
CPC ..... C22C 38/002; C22C 38/02; C22C 38/06; C22C 38/08; C22C 38/14; C22C 38/16; C22C 38/24; C22C 38/38
USPC ..... 148/620
See application file for complete search history.

(56) References Cited

U.S. PATENT DOCUMENTS

| | | | | |
|---|---|---|---|---|
| 2016/0168672 | A1 | 6/2016 | Kobayashi et al. | |
| 2017/0306462 | A1* | 10/2017 | Kobayashi ..... | C22C 38/002 |

FOREIGN PATENT DOCUMENTS

| | | | |
|---|---|---|---|
| CN | 101597721 | A | 12/2009 |
| CN | 102691016 | A | 9/2012 |
| CN | 105408512 | A | 3/2016 |
| EP | 174418 | A2 * | 3/1986 |
| EP | 3202938 | A1 | 8/2017 |
| JP | S51018916 | A | 2/1976 |
| JP | S52036513 | A | 3/1977 |
| JP | S60039150 | A | 2/1985 |
| JP | H09-249940 | A | 9/1997 |
| JP | H10121202 | A | 5/1998 |
| JP | H110121204 | A | 5/1998 |
| JP | 2008-519160 | A | 6/2008 |
| JP | 2017031483 | A | 2/2017 |
| RU | 2563397 | C2 | 9/2015 |
| RU | 2573153 | C2 | 1/2016 |
| RU | 2574555 | C2 | 2/2017 |
| WO | 2015012357 | A1 | 1/2015 |
| WO | 2016052397 | A1 | 4/2016 |

OTHER PUBLICATIONS

Nov. 5, 2019 (CN)—Office Action Applicaiton No. 201780022079.X.
English Abstract of CN-105408512A.
English Abstract of CN-101307415A.
English Abstract of CN-102691016A.
English Abstract of CN-1295139A.
Mar. 25, 2019 (EP)—Extended European Search Report App. No. 17774355.6.
Mar. 28, 2019 (RU)—Decision of Grant with Search Report App. 2018137852/02 (062753).
English Abstract of CN101597721A.
English Abstract of RU2573153C2.
English Abstract of RU2574555C2.
English Abstract of RU2563397C2.
English Abstract of JP2008-519160A.
Machine translation of CN101307415.

* cited by examiner

HIGH-STRENGTH STEEL MATERIAL AND PRODUCTION METHOD THEREFOR

RELATED APPLICATION DATA

This application is a National Stage Application under 35 U.S.C. 371 of co-pending PCT application number PCT/JP2017/010531 designating the United States and filed Mar. 15, 2017; which claims the benefit of JP application number 2016-067741 and filed Mar. 30, 2016 each of which are hereby incorporated by reference in their entireties.

TECHNICAL FIELD

The present invention relates to a high-strength steel material and a method for producing the high-strength steel material.

BACKGROUND ART

Oil wells and gas wells (hereunder, oil wells and gas wells are referred to collectively as "oil wells") are being made increasingly deeper. Consequently, there is a demand to enhance the strength of oil-well steel pipes such as those used for casing and tubing for use in oil wells (hereunder, referred to as "oil country tubular goods").

In addition, the inside of many recently developed deep wells is an acidified severe environment (sour environment) that contains corrosive hydrogen sulfide ($H_2S$). Under such an environment, oil country tubular goods sometimes fracture due to sulfide stress cracking (hereinafter, referred to as "SSC"). Furthermore, it is widely known that the susceptibility of steel to SSC increases with the enhancement of the steel strength.

Under such circumstances, in particular, there are increasing demands with respect to strength enhancement and also SSC resistance of steel materials to be used as casings that serve as the wall (outer pipe) of an oil well. Currently, even in the case of the so-called "110 ksi grade" that has a yield stress (hereinafter, also abbreviated to "YS") of 758 to 862 MPa, oil country tubular goods that do not exhibit SSC in an environment in which a $H_2S$ partial pressure is 1 atm, or in the case of the so-called "125 ksi grade" that has a YS of 862 to 965 MPa, oil country tubular goods that do not exhibit SSC in an environment in which a $H_2S$ partial pressure is 0.03 atm are in use.

Note that the aforementioned "SSC" is one kind of hydrogen embrittlement that leads to rupture of the steel material due to a synergistic effect between diffusion into the steel of hydrogen generated on the surface of the steel material in a corrosive environment and stress that is applied to the steel material.

Thus, with respect to the development of high-strength oil country tubular goods, there is a demand for not only strength enhancement, but also to provide good SSC resistance.

Furthermore, as oil well environments become increasingly hostile, even higher safety is demanded for oil country tubular goods, and from the viewpoint of SSC prevention, in addition to conventional demands that the results of a constant load test based on "Method A" described in NACE TM0177-2005 and the results of an bent beam test based on "Method B" described in the NACE TM0177-2005 are favorable, recently demands have also begun to be made for a fracture toughness value (hereinafter, referred to as "$K_{ISSC}$") in a sour environment that is the result of a DCB test based on "Method D" described in NACE TM0177-2005 to be a high value.

For example, considering a case in which a crack of 0.5 mm is present in a casing having a wall thickness of 15.9 mm that is a typical size, if a yield stress of 758 MPa that is the specified minimum yield stress for so-called "110 ksi grade" is applied, the stress intensity factor at the crack bottom will be 33.7 $MPa \cdot m^{0.5}$. Therefore, a value that is equal to or greater than 33.7 $MPa \cdot m^{0.5}$ is required for the $K_{ISSC}$.

Note that, with regard to the relation between crystal structure and hydrogen embrittlement, it is known that austenitic steel material and Ni-based alloy material having a face-centered cubic (fcc) structure generally have superior hydrogen embrittlement resistance characteristics in comparison to carbon steel material and low-alloy steel material that have a body-centered cubic (bcc) structure or a body-centered tetragonal (bct) structure (hereinafter, in the present description these structures are referred to collectively as "bcc structure").

However, in general, an austenitic material has a low strength when left as it is in a state after a solution heat treatment (hereinafter, may be referred to as "solid solution heat treatment"), and a large amount of an expensive constituent element such as Ni is generally added to stabilize the austenite, and hence the material cost increases markedly.

Mn is an element which has an austenite stabilizing action, and which is less expensive than the aforementioned Ni. Therefore, various technologies have been disclosed that relate to a high-strength and high-Mn austenitic steel material.

For example, Patent Document 1 discloses a steel material and a method for producing the steel material in which the steel material contains, by mass %, 5.0 to 45.0% of Mn and 0.5 to 2.0% of V. More specifically, the steel material contains, by mass %, C: 0.10 to 1.2%, Si: 0.05 to 1.0%, Mn: 5.0 to 45.0% and V: 0.5 to 2.0% as essential elements, limits the content of P and S as impurities to a specific amount or less, and as necessary further contains a specific amount of one or more elements selected from the group consisting of Cr, Ni, Cu and N, and has a substantially austenite single-phase steel micro-structure and a yield stress (YS) of 758 MPa (77.3 $kgf/mm^2$) or more.

Patent Document 2 discloses a steel material and a method for producing the steel material in which the steel material contains, by mass %, C: 1.2% or less, Si: 0.05 to 1.0% and Mn: 5 to 45% as essential elements, limits the content of P and S as impurities to a specific amount or less, and as necessary further contains a specific amount of one or more elements selected from the group consisting of Cr, Ni, Mo, Cu and N, and which has a steel micro-structure that is substantially composed of austenite and c-martensite, and has a yield stress (YS) of 758 MPa (77.3 $kgf/mm^2$) or more.

Patent Document 3 discloses a steel material that has a chemical composition containing, by mass %, C: 0.60 to 1.4%, Si: 0.05 to 1.00%, Mn: 12 to 25% and Al: 0.003 to 0.06% as essential elements, limits the content of P and S as impurities to a specific amount or less, and as necessary further contains a specific amount of one or more elements selected from the group consisting of N, Cr, Mo, Cu, Ni, V, Nb, Ti, Zr, Ca, Mg and B, in which Nieq (=Ni+30C+0.5 Mn)≥27.5, the steel micro-structure has an FCC structure as the main structure and a total volume fraction of ferrite and α'-martensite is less than 0.10%, and which has a YS of 862 MPa or more.

LIST OF PRIOR ART DOCUMENTS

Patent Document

Patent Document 1: JP9-249940A
Patent Document 2: JP10-121202A
Patent Document 3: WO 2015/012357

SUMMARY OF INVENTION

Technical Problem

Even though the steel material disclosed in Patent Document 1 is an austenitic steel material, if V that completely dissolves in the austenite matrix sufficiently precipitates as V carbides, the steel material can certainly have a YS of 758 MPa (77.3 kgf/mm$^2$) or more. However, only V carbides are such precipitates that precipitate as a result of aging treatment after solution heat treatment and contribute to strength enhancement, and furthermore the V content is as low as, by mass %, 0.5 to 2.0%. Therefore, to stably secure a high strength which is a YS of 758 MPa or more by precipitation strengthening by V carbides, an aging treatment over a prolonged period of, for example, more than 3 hours is required. Therefore, this is disadvantageous from the viewpoint of productivity, and in some cases results in mounting energy costs (see Table 3 and Table 4 in Examples in Patent Document 1). In addition, in Patent Document 1, because an evaluation of the $K_{ISSC}$ by a DCB test is not performed, there remains room for investigation regarding the SSC resistance in stress concentrating zones such as the vicinity of a crack front end.

In the steel material disclosed in Patent Document 2, strength enhancement is secured by cold working after a solution heat treatment. Therefore, even though the steel material is an austenitic steel material, it is certainly possible for the steel material to have a YS of 758 MPa (77.3 kgf/mm$^2$) or more. However, to stably secure high strength, cold working in which the reduction of area is 25% or more, for example, is necessary. Therefore, in a case where the reduction of area during cold working cannot be made large due to constraints relating to the equipment or product size or the like, the desired high strength of a YS of 758 MPa or more cannot be secured in some cases (see Table 2 and Table 3 in the in Examples in Patent Document 2), even though the SSC resistance is favorable. On the other hand, depending on the chemical composition of the steel material, although the desired YS strength of 758 MPa or more can be secured, it is assumed that α'-martensite having a bcc structure may be formed by strain induced transformation and lead to a decrease in SSC resistance. In addition, with respect to Patent Document 2 also, because an evaluation of the $K_{ISSC}$ by a DCB test is not performed, there remains room for investigation regarding the SSC resistance in stress concentrating zones such as the vicinity of a crack front end.

In the steel material disclosed in Patent Document 3, strength enhancement is secured by cold working after a solid solution heat treatment. Further, in a case where one or more elements selected from the group consisting of V, Nb, Ta, Ti and Zr that are optional elements is contained, more noticeable strength enhancement is achieved by an aging heat treatment that is performed after a solid solution heat treatment, and cold working that is performed after the aging heat treatment. Therefore, irrespective of the fact that the steel material is an austenitic steel material, it is certainly possible for the steel material to have a YS of 862 MPa or more. Furthermore, in a test conducted by a four-point bending method using a plate-shaped smooth test specimen, excellent SSC resistance and stress corrosion cracking resistance as well as general corrosion resistance were exhibited. However, cold working of steel starting material subjected to precipitation strengthening by means of various kinds of carbides or carbo-nitrides that precipitated in the aging heat treatment is performed in order to secure a marked strength enhancement effect in a case of containing the aforementioned various kinds of optional elements, and consequently there is a concern that an extremely large load will be placed on the cold working equipment. Further, in Patent Document 3 also, because an evaluation of the $K_{ISSC}$ by a DCB test is not performed, there remains room for investigation regarding the SSC resistance in stress concentrating zones such as the vicinity of a crack front end.

An objective of the present invention is to provide an austenitic high-strength steel material for which a YS of 758 MPa or more can be stably secured and for which the $K_{ISSC}$ in a DCB test is 33.7 MPa·m$^{0.5}$ or more, as well as a method for producing the austenitic high-strength steel material.

Solution to Problem

The present invention has been made to solve the problem described above, and the gist of the present invention is a high-strength steel material and a method for producing the high-strength steel material that are described hereunder.

(1) A high-strength steel material having a chemical composition consisting, by mass percent, of C: 0.30 to 1.0%,
Si: 0.05 to 1.0%,
Mn: 16.0 to 35.0%,
P: 0.030% or less,
S: 0.030% or less,
Al: 0.003 to 0.06%,
N: 0.1% or less,
V: 0 to 3.0%,
Ti: 0 to 1.5%,
Nb: 0 to 1.5%,
Cr: 0 to 5.0%,
Mo: 0 to 3.0%,
Cu: 0 to 1.0%,
Ni: 0 to 1.0%,
B: 0 to 0.02%,
Zr: 0 to 0.5%,
Ta: 0 to 0.5%,
Ca: 0 to 0.005%,
Mg: 0 to 0.005%, and
the balance: Fe and impurities,
and satisfying formula (i) hereunder,
wherein:

a number density of carbides and/or carbo-nitrides having a circle-equivalent diameter of 5 to 30 nm precipitating in the steel is 50 to 700/μm$^2$, and a number density of carbides and/or carbo-nitrides having a circle-equivalent diameter of more than 100 nm precipitating in the steel is less than 10/μm$^2$, a yield stress is 758 MPa or more, and a $K_{ISSC}$ value obtained in a DCB test is 33.7 MPa·m$^{0.5}$ or more;

$$V+Ti+Nb>2.0 \quad \text{(i)}$$

where, V, Ti and Nb in formula (i) above represent a content (mass %) of the respective elements contained in the steel, with the value thereof being set to zero in a case where the corresponding element is not contained.

(2) The high-strength steel material according to (1) above, wherein the chemical composition contains, by mass %, one or more elements selected from:

V: 0.1 to 3.0%,
Ti: 0.003 to 1.5%,
Nb: 0.003 to 1.5%,
Cr: 0.1 to 5.0%,
Mo: 0.5 to 3.0%,
Cu: 0.1 to 1.0%,
Ni: 0.1 to 1.0%,
B: 0.0001 to 0.02%,
Zr: 0.005 to 0.5%,
Ta: 0.005 to 0.5%,
Ca: 0.0003 to 0.005%, and
Mg: 0.0003 to 0.005%.

(3) A method for producing a high-strength steel material according to (1) or (2) above, the method including performing steps of (a) to (f) described hereunder in sequence on a steel material having a chemical composition described in (1) or (2) above:

(a) a hot working step of heating to a temperature in a range of 900 to 1200° C., and thereafter finishing into a predetermined shape;

(b) a cooling step of cooling to a temperature of 100° C. or less;

(c) a solid solution heat treatment step of heating to a temperature in a range of 800 to 1200° C. and holding at the temperature for not less than 10 minutes, and thereafter quenching;

(d) a cold working step of performing working with a reduction of area in a range of 5 to 20%;

(e) an aging treatment steps of holding at a temperature of 600 to 750° C. for 0.5 to 2 hours; and (f) a cooling step of cooling to a temperature of 100° C. or less.

(4) A method for producing a high-strength steel material according to (1) or (2) above, the method including performing steps of (g) to (k) described hereunder in sequence on a steel material having a chemical composition described in (1) or (2) above:

(g) a hot working step of heating to a temperature in a range of 900 to 1200° C., and thereafter finishing into a predetermined shape at a temperature of 800° C. or more;

(h) a solid solution heat treatment step of quenching immediately following the step of (g);

(i) a cold working step of performing working with a reduction of area in a range of 5 to 20%;

(j) an aging treatment steps of holding at a temperature of 600 to 750° C. for 0.5 to 2 hours; and (k) a cooling step of cooling to a temperature of 100° C. or less.

Advantageous Effects of Invention

According to the present invention, a high-strength steel material can be obtained in which the yield stress is 758 MPa or more and a $K_{ISSC}$ obtained in a DCB test is 33.7 MPa·m$^{0.5}$ or more.

DESCRIPTION OF EMBODIMENTS

In order to solve the aforementioned problem, the present inventors conducted concentrated studies regarding techniques that raise the YS as well as the $K_{ISSC}$ in a DCB test, using comparatively inexpensive high-Mn steel materials whose chemical compositions were adjusted in various ways. As a result, the present inventors obtained the following important findings.

(A) Although austenite can be stabilized by containing, by mass %, 0.30% or more of C and 16.0% or more of Mn even if expensive Ni is not contained, if only subjected to a solid solution heat treatment, a YS of 758 MPa or more is not stably obtained.

(B) The YS of an austenitic steel material can be raised by performing an aging treatment after a solid solution heat treatment to thereby cause carbides and/or carbo-nitrides of V, Nb and Ti to precipitate, so as to utilize the strengthening action of the precipitates.

(C) In order to stably secure a precipitation strengthening action of carbides and/or carbo-nitrides of V, Nb and Ti, it is necessary for the total content of V, Nb and Ti to be more than 2.0%.

(D) To secure the required amount of carbides and/or carbo-nitrides, it is preferable to lengthen the aging treatment time period. However, an aging treatment performed for a long time period not only leads to an increase in cost but also causes formation of coarse carbides or carbo-nitrides and, on the contrary, lowers the yield stress. Therefore, it is desirable to cause the required amount of carbides and/or carbo-nitrides to precipitate by means of an aging treatment that is performed for a short time.

(E) If an aging treatment is carried out after performing cold working after a solid solution heat treatment, dislocations introduced by the cold working serve as nucleation sites for the aforementioned carbides and carbo-nitrides. Therefore, the steel can be strengthened by an aging treatment in a shorter time in comparison to a case where cold working is not performed. Furthermore, by containing V, Nb and Ti in an amount that is more than 2.0% in total, a large strengthening action is obtained by performing moderate cold working in which a reduction of area is 20% or less, and thereafter performing an aging treatment for a short time of not more than two hours. As a result, there are fewer constraints in terms of the equipment, product size and production cost.

Figure 1:
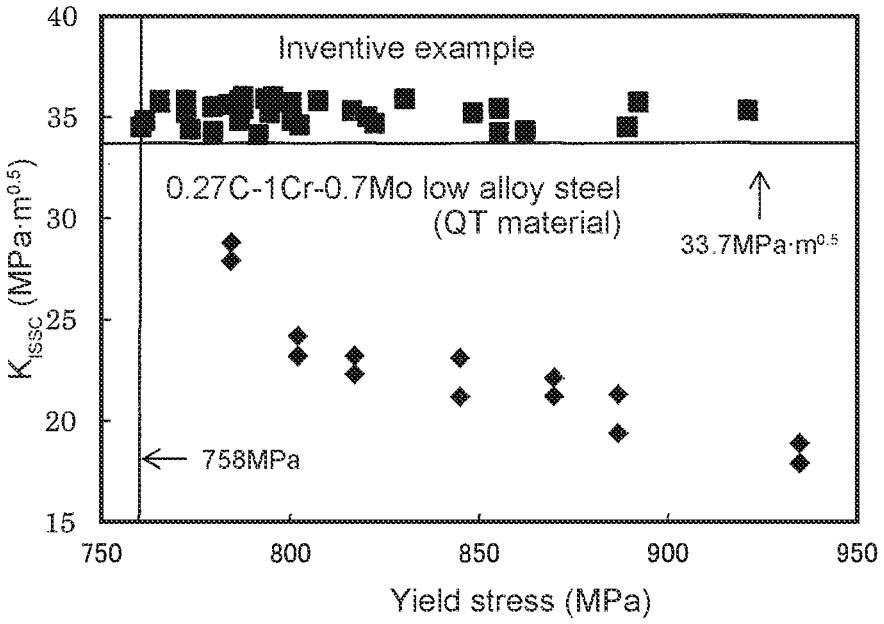
FIG. 1 is a view showing a comparison between $K_{ISSC}$ values obtained by a DCB test defined in NACE TM0177-2005 in a high-strength region in which the YS is 758 MPa or more with respect to high-Mn steel material of "inventive example" in the Examples in which a crystal structure is an fcc structure and conventional types of low-alloy steel material in which a crystal structure is a bcc structure (low-alloy steel material obtained by subjecting a 0.27% C-1% Cr-0.7% Mo low alloy steel to a quenching and tempering treatment (denoted by "QT" in the drawing)).

(F) In a high-strength region in which the YS is 758 MPa or more, although the $K_{ISSC}$ which is determined by a DCB test defined in NACE TM0177-2005 decreases markedly accompanying an increase in the YS in a low-alloy steel material having a bcc structure, in a high-Mn steel material having an fcc structure the $K_{ISSC}$ has a large value of 33.7 MPa·m$^{0.5}$ or more irrespective of the YS (see FIG. 1).

The present invention has been completed based on the above findings. The respective requirements of the present invention are described in detail hereunder.

1. Chemical Composition

The reasons for limiting the chemical composition of the steel material according to the present invention are as follows. The symbol "%" with respect to the content of each element in the following description represents "mass percent".

C: 0.30 to 1.0%

By containing C in combination with Mn that is described later, C has an effect that stabilizes austenite even if expensive Ni is not contained. In addition, during an aging treatment, C forms fine carbides and/or carbo-nitrides by combining with one or more elements among V, Ti and Nb, and thereby contributes to enhancing the strength of the steel material. However, the aforementioned effects are difficult to obtain if the C content is less than 0.30%. On the other hand, if the C content is more than 1.0%, cementite precipitates and lowers the grain boundary strength, and causes a reduction in the SSC resistance and hot workability. Therefore, the C content is set within a range of 0.30 to 1.0%. The C content is preferably 0.40% or more. Further, the C content is preferably 0.90% or less, and more preferably is less than 0.60%.

Si: 0.05 to 1.0%

Si is an effective element for deoxidation of steel. To obtain this effect, the content of Si has to be 0.05% or more. On the other hand, if the Si content is more than 1.0%, the Si weakens the grain boundary strength and leads to a reduction in SSC resistance. Therefore, the Si content is set within a range of 0.05 to 1.0%. The Si content is preferably 0.1% or more, and is preferably not more than 0.8%.

Mn: 16.0 to 35.0%

By containing Mn in combination with the aforementioned C, Mn has an action that stabilizes austenite which is achieved at a low cost. To adequately obtain this effect, 16.0% or more of Mn has to be contained. On the other hand, Mn dissolves preferentially in wet hydrogen sulfide environments, and if the content of Mn is more than 35.0%, the Mn causes a decrease in the general corrosion resistance. Therefore, the Mn content is set within a range of 16.0 to 35.0%. The Mn content is preferably 18.0% or more, and more preferably is 19.0% or more. Further, the Mn content is preferably 30.0% or less, and more preferably is 25.0% or less.

P: 0.030% or Less

P is an element that segregates at grain boundaries and has an adverse effect on SSC resistance. Therefore, it is necessary to limit the P content to 0.030% or less. The content of P, which is an impurity, is preferably as low as possible, and is preferably 0.020% or less. A lower limit of the P content is not particularly set, and includes 0%. However, because excessive reduction of the P content leads to a rise in the production cost of the steel material, the lower limit of the P content may preferably be set to around 0.001%.

S: 0.030% or Less

S is present as an impurity in the steel and, in particular, if the content of S is more than 0.030%, S segregates at grain boundaries and also forms sulfide-based inclusions and lowers the SSC resistance. Therefore, the S content is set to 0.030% or less. The content of S, which is an impurity, is also preferably as low as possible, and is preferably 0.015% or less. A lower limit of the S content is not particularly set, and includes 0%. However, because excessive reduction of the S content leads to a rise in the production cost of the steel material, the lower limit of the S content may preferably be set to around 0.001%.

Al: 0.003 to 0.06%

Al is an effective element for deoxidation of steel. To obtain this effect, the content of Al has to be 0.003% or more. On the other hand, if the Al content is more than 0.06%, in particular oxide-based inclusions coarsen and exert an adverse effect on toughness and SSC resistance. Therefore, the Al content is set within a range of 0.003 to 0.06%. The Al content is preferably not less than 0.008%, and is preferably not more than 0.05%. Note that the term "Al content" in the present invention means the content of acid-soluble Al (so-called "Sol.Al").

N: 0.1% or Less

N forms fine carbo-nitrides by combining with one or more elements among V, Ti and Nb during an aging treatment, and thereby contributes to enhancing the strength of the steel material. However, if the N content is more than 0.1%, it results in a decrease in hot workability. Therefore, the N content is set to 0.1% or less. The N content is preferably 0.08% or less. To obtain the aforementioned effect, preferably the N content is not less than 0.004%, and more preferably is not less than 0.010%.

V: 0 to 3.0%

V is an element that contributes to strength enhancement by combining with C or in addition N during an aging treatment to form fine carbides and/or carbo-nitrides. Therefore, V may be contained as necessary. However, even if a surplus amount of V is contained, not only does the aforementioned effect saturate and lead to in an increase in the material cost, the surplus amount of V may also cause a decrease in toughness and destabilization of austenite. Therefore, the V content is set to 3.0% or less. The V content is preferably 2.9% or less. To obtain the aforementioned effect, preferably the V content is not less than 0.1%, and more preferably is not less than 1.0%.

Ti: 0 to 1.5%

Ti is an element that contributes to strength enhancement by combining with C or in addition N during an aging treatment to form fine carbides and/or carbo-nitrides. Therefore, Ti may be contained as necessary. However, even if a surplus amount of Ti is contained, not only does the aforementioned effect saturate and lead to in an increase in the material cost, the surplus amount of Ti may also cause a decrease in toughness and destabilization of austenite. Therefore, the Ti content is set to 1.5% or less. The Ti content is preferably 1.1% or less. To obtain the aforementioned effect, preferably the Ti content is not less than 0.003%, and more preferably is not less than 0.1%.

Nb: 0 to 1.5%

Nb is an element that contributes to strength enhancement by combining with C or in addition N during an aging treatment to form fine carbides and/or carbo-nitrides. Therefore, Nb may be contained as necessary. However, even if a surplus amount of Nb is contained, not only does the aforementioned effect saturate and lead to an increase in the material cost, the surplus amount of Nb may also cause a decrease in toughness and destabilization of austenite. Therefore, the Nb content is set to 1.5% or less. The Nb content is preferably 1.1% or less. To obtain the aforementioned effect, preferably the Nb content is not less than 0.003%, and more preferably is not less than 0.1%.

$$V+Ti+Nb>2.0 \quad \text{(i)}$$

Where, V, Ti and Nb in formula (i) above represent a content (mass %) of the respective elements contained in the steel, with the value thereof being set to zero in a case where the corresponding element is not contained.

The left-hand value in the above formula (i) is an index of the strength enhancement achieved by formation of fine carbides and/or carbo-nitrides of V, Ti and Nb after an aging treatment, and at the same time is also an index for securing a high strength that is a YS of 758 MPa or more by cold working with a reduction of area of 20% or less and aging treatment for not more than two hours thereafter.

In other words, when the total content of V, Ti and Nb is more than 2.0%, a high strength in which the YS is 758 MPa or more can be stably secured by means of moderate cold working in which a reduction of area is 20% or less that is performed after a solid solution heat treatment, and thereafter performing an aging treatment for a short time of not more than two hours. The left-hand value in formula (i) is preferably not less than 2.1. Further, although an upper limit thereof is not particularly defined, the upper limit is preferably not more than 4.0, and an upper limit of 3.0 or less is preferable.

Note that, as long as the above formula (i) is satisfied, any one of the aforementioned three elements may be contained, or two of the three elements may be contained in combination, or a combination of all three elements may be contained.

Cr: 0 to 5.0%

Cr is an element that improves general corrosion resistance. Therefore, Cr may be contained as necessary. However, if Cr is contained in an amount that is more than 5.0%, the SSC resistance will be lowered. Therefore, the Cr content is set to not more than 5.0%. The Cr content is preferably not more than 4.5%. To obtain the aforementioned effect, the Cr content is preferably 0.1% or more.

Mo: 0 to 3.0%

Mo is an element that improves general corrosion resistance. Therefore, Mo may be contained as necessary. However, even if Mo is contained in an amount that is more than 3.0%, the aforementioned effect saturates and thus results in an increase in the material cost. Therefore, the Mo content is set to not more than 3.0%. The Mo content is preferably not more than 2.0%. To obtain the aforementioned effect, the Mo content is preferably 0.5% or more.

The total amount of the aforementioned Cr and Mo in a case where these two elements are contained in combination is preferably not more than 5.0%.

Cu: 0 to 1.0%

Cu is an effective element for stabilizing austenite. Therefore, Cu may be contained as necessary. However, if a large amount of Cu is contained, the Cu will promote local corrosion, and form a stress concentrating zone on the surface of the steel material. Therefore, the Cu content is set to not more than 1.0%. The Cu content is preferably not more than 0.8%. To obtain the aforementioned effect, the Cu content is preferably 0.1% or more.

Ni: 0 to 1.0%

Ni is an effective element for stabilizing austenite. Therefore, Ni may be contained as necessary. However, if a large amount of Ni is contained, the Ni will promote local corrosion, and form a stress concentrating zone on the surface of the steel material. Therefore, the Ni content is set to not more than 1.0%. The Ni content is preferably not more than 0.8%. To obtain the aforementioned effect, the Ni content is preferably 0.1% or more.

The total amount of the aforementioned Cu and Ni in a case where a combination of these two elements is contained is preferably not more than 1.0%.

B: 0 to 0.02%

B has an action that refines precipitates and an action that refines austenite grains. Therefore, B may be contained as necessary. However, if the content of B is excessive, it results in a deterioration in hot workability. Therefore, the B content is set to 0.02% or less. The B content is preferably 0.015% or less. To obtain the aforementioned effects, the B content is preferably 0.0001% or more.

Zr: 0 to 0.5%

Zr is an element that forms carbides and/or carbo-nitrides and has a precipitation strengthening action. Therefore, Zr may be contained as necessary. However, even if a large amount of Zr is contained, not only does the aforementioned effect saturate and lead to an increase in the material cost, it may also cause a decrease in toughness and destabilization of austenite. Therefore, the Zr content is set to 0.5% or less. The Zr content is preferably not more than 0.4%. To stably obtain the aforementioned effect, preferably the Zr content is not less than 0.005%.

Ta: 0 to 0.5%

Ta is an element that forms carbides and/or carbo-nitrides and has a precipitation strengthening action. Therefore, Ta may be contained as necessary. However, even if a large amount of Ta is contained, not only does the aforementioned effect saturate and lead to an increase in the material cost, it may also cause a decrease in toughness and destabilization of austenite. Therefore, the Ta content is set to 0.5% or less. The Ta content is preferably not more than 0.4%. To obtain the aforementioned effect, preferably the Ta content is not less than 0.005%.

The total amount of the aforementioned Zr and Ta in a case where a combination of these two elements is contained is preferably not more than 0.5%.

Ca: 0 to 0.005%

Ca has an action that controls the form of inclusions to improve toughness and corrosion resistance. Therefore, Ca may be contained as necessary. However, if a large amount of Ca is contained, inclusions may become clustered and therefore the Ca may, on the contrary, cause a deterioration in toughness and in corrosion resistance. Therefore, the Ca content is set to not more than 0.005%. The Ca content is preferably not more than 0.003%. To obtain the aforementioned effect, preferably the Ca content is not less than 0.0003%.

Mg: 0 to 0.005%

Mg has an action that controls the form of inclusions to improve toughness and corrosion resistance. Therefore, Mg may be contained as necessary. However, if a large amount of Mg is contained, inclusions may become clustered and therefore the Mg may, on the contrary, cause a deterioration in toughness and in corrosion resistance. Therefore, the Mg content is set to not more than 0.005%. The Mg content is preferably not more than 0.003%. To obtain the aforementioned effect, preferably the Mg content is not less than 0.0003%.

The total amount of the aforementioned Ca and Mg in a case where a combination of these two elements is contained is preferably not more than 0.005%.

In the steel material according to the present invention, the balance is Fe and impurities.

Here, the term "impurities" refers to components which, during industrial production of ferrous metal materials, are mixed in from raw material such as ore or scrap or due to various factors in the production process, and which are allowed to be contained in an amount that does not adversely affect the present invention.

2. Precipitates

As described above, an austenitic steel material generally has low strength. Therefore, in the present invention, the steel material is strengthened by causing carbides and/or carbo-nitrides (hereinafter, these are also referred to together as "precipitates") to precipitate. The precipitates precipitate inside the steel material, and contribute to strengthening by making it difficult for dislocations to move. If the size of these precipitates is a circle-equivalent diameter of less than 5 nm, the precipitates do not function as an obstacle when dislocations move. On the other hand, if the precipitates become coarse precipitates having a size that is a circle-equivalent diameter of more than 30 nm, the precipitates do not contribute to strengthening because the number of precipitates decreases extremely. Therefore, a size of the precipitates that is suitable for precipitation strengthening of the steel material is a size in a range of 5 to 30 nm.

To stably obtain a yield stress of 758 MPa or more, it is necessary for the number density of the aforementioned precipitates having a circle-equivalent diameter of 5 to 30 nm in the steel micro-structure to be in a range of 50 to 700/$\mu m^2$. The number density of the precipitates having a circle-equivalent diameter of 5 to 30 nm is preferably not less than 100/$\mu m^2$, and more preferably is not less than 150/$\mu m^2$. Further, the number density of the precipitates having a circle-equivalent diameter of 5 to 30 nm is preferably not more than 650/$\mu m^2$, and more preferably is not more than 600/$\mu m^2$.

On the other hand, if the number density of coarse precipitates having a circle-equivalent diameter of more than 100 nm is excessive, on the contrary, not only will the yield stress be reduced, but the toughness will also be weakened. Therefore, it is necessary for the number density of precipitates having a circle-equivalent diameter of more than 100 nm to be less than 10/$\mu m^2$. The number density of precipitates having a circle-equivalent diameter of more than 100 nm is preferably less than 7/$\mu m^2$, and more preferably is less than 5/$\mu m^2$.

Note that precipitates having a circle-equivalent diameter that is more than 30 nm and not more than 100 nm do not significantly influence the properties of the steel material, and hence a particular limitation is not set with respect to the number density of such precipitates. However, if an excessive amount of the aforementioned precipitates are present, there is a risk that it will not be possible to secure a sufficient amount of precipitates having a circle-equivalent diameter in the range of 5 to 30 nm. Therefore, the number density of precipitates having a circle-equivalent diameter that is more than 30 nm and not more than 100 nm is preferably 70/$\mu m^2$ or less, and more preferably is 60/$\mu m^2$ or less.

In the present invention, the number density of precipitates is measured by the following method. A thin film having a thickness of 100 nm is prepared from the inside of the steel material (central portion of wall thickness), the thin film is observed using a transmission electron microscope (TEM), and the number of the aforementioned precipitates having a circle-equivalent diameter in the range of 5 to 30 nm, the number of the aforementioned precipitates having a circle-equivalent diameter that is more than 30 nm and not more than 100 nm, and the number of the aforementioned precipitates having a circle-equivalent diameter of more than 100 nm that are included in a visual field of 1 μm square are counted, respectively. Measurement of the number density is performed in three visual fields or more, and the average value thereof is calculated.

3. YS of High-Strength Steel Material

The YS of the high-strength steel material according to the present invention is 758 MPa or more. When the YS is 758 MPa or more, the high-strength steel material is capable of supposing the recent deepening of oil wells in a sufficiently stable manner. The YS is preferably 760 MPa or more. Further, the YS is preferably not more than 1000 MPa, and more preferably is not more than 950 MPa. Note that the term "YS" in the present invention refers to "YS in a room-temperature atmosphere".

4. $K_{ISSC}$ of High-Strength Steel Material

The $K_{ISSC}$ of the high-strength steel material according to the present invention is 33.7 MPa·$m^{0.5}$ or more. When the $K_{ISSC}$ is 33.7 MPa·$m^{0.5}$ or more, the SSC resistance in stress concentrating zones such as the vicinity of a crack front end is not a problem, and the high-strength steel material is capable of supposing the recent deepening of oil wells in sour environments in a sufficiently stable manner. The $K_{ISSC}$ is preferably 34.0 MPa·$m^{0.5}$ or more. Further, the upper limit of the $K_{ISSC}$ is assumed to be 50.0 MPa·$m^{0.5}$ Note that the term "$K_{ISSC}$" in the present invention refers to a value determined by a DCB test using a test specimen and a wedge having the shapes shown in FIG. 2 and FIG. 3, which is defined by NACE TM0177-2005.

5. Production Method

The high-strength steel material of the present invention can be produced by the following method.

High-Mn steel having the aforementioned chemical composition is melted using a similar method as the method used for general austenitic steel, and thereafter the molten steel is formed into an ingot or a cast piece by casting. Note that, in the case of producing a seamless steel pipe, the steel may be cast into a cast piece having a round billet shape for pipe-making by a so-called "round continuous casting" method.

As the next process, the cast ingot or cast piece is subjected to blooming or hot forging. This process is performed for obtaining starting material to be used in the final hot working (for example, hot rolling, hot extrusion, hot forging) for working into a predetermined shape such as a thick plate, a round bar or a seamless steel pipe. Note that, depending on the aforementioned "round continuous casting" method, a cast piece that was formed into a round billet shape can be directly finished into a steel pipe, and hence blooming or hot forging need not necessarily be performed.

The high-strength steel material of the present invention is produced by performing the steps of (a) to (f) described hereunder (a case where the steel material is reheated after a hot working step, and subjected to a solid solution heat treatment) or the steps of (g) to (k) described hereunder (a case where, after a hot working step, the steel material is directly subjected to a solid solution heat treatment) in sequence on starting material and a cast piece formed into a round billet shape (hereinafter, referred to as "steel material") that are used for the final hot working, which were produced by the aforementioned blooming or hot forging.

(5-1) Production Method in a Case of Reheating after Hot Working Step, and Subjecting to Solid Solution Heat Treatment (a) Hot Working Step The aforementioned steel material is heated to 900 to 1200° C., and thereafter is finished into a predetermined shape. If the heating temperature is lower than 900° C., the deformation resistance during hot working becomes larger and the load applied to the processing equipment increases, and processing defects such as flaws or cracks may occur. On the other hand, if the heating temperature is higher than 1200° C., it may cause high-temperature intergranular cracking or a reduction in ductility. Therefore, the heating temperature during the hot working step is set in the range of 900 to 1200° C. The heating temperature is preferably set to not less than 950° C., and is preferably set to not more than 1150° C.

The heating temperature in this process refers to the temperature on the surface of the steel material. Note that, although also depending on the size or shape of the product, the holding time in the aforementioned temperature range is preferably set to between 10 and 180 minutes, and more preferably is set to between 20 and 120 minutes. Further, the finishing temperature of the hot working is preferably set to between 800 and 1150° C., and more preferably is set to between 1000 and 1150° C.

(b) Cooling Step

After being finished into a predetermined shape, the steel material is cooled to a temperature of not more than 100° C. The cooling rate at such time is not particularly limited.

(c) Solid Solution Heat Treatment Step

After the steel material is cooled to a temperature of not more than 100° C., it is necessary for precipitates such as carbides to be adequately dissolved in the austenite matrix. Therefore, in the present invention, to adopt temperature and time conditions so that precipitates and the like can be adequately dissolved and, furthermore, coarsening of austenite grains does not occur, the steel material is held for 10 minutes or more at a temperature in the range of 800 to 1200° C. The solid solution heat treatment temperature is preferably set to not less than 1000° C., and is preferably set to not more than 1150° C.

The heating temperature in this process also refers to the temperature on the surface of the steel material. Although the holding time in the aforementioned temperature range of the solid solution heat treatment also depends on the size or shape of the product, the holding time is preferably set to not less than 20 minutes, and is preferably set to not more than 180 minutes. Note that quenching after the steel material is held for the aforementioned time may be performed by an appropriate method such as water cooling, oil cooling or mist cooling at a cooling rate of a degree such that precipitation of carbides and intermetallic compounds during cooling can be prevented and which also does not produce thermal strain. Water cooling or oil cooling or the like at a rate of 1° C./sec or more may be mentioned as an example of the specific cooling rate. Note that, at such time, the cooling is preferably performed at a cooling rate of 10° C./sec or more in the temperature range until 300° C.

(d) Cold Working Step

Cold working with a reduction of area of 5 to 20% is performed to secure nucleation sites of carbides and carbonitrides with respect to the steel material that was quenched in the solid solution heat treatment step. If the reduction of area is less than 5%, in some cases a high strength of a YS of 758 MPa or more cannot be secured. On the other hand, if the reduction of area is more than 20%, in some cases constraints arise with regard to the equipment or product size or the like. The reduction of area is preferably 18% or less.

As long as the reduction of area is in the range of 5 to 20%, the number of times cold working is performed is not particularly limited, and may be a single time or multiple times. However, in a case of performing cold working multiple times, while naturally the cold working has to be performed in a manner that ensures that the total reduction of area is not more than 20%, it is necessary to perform the cold working without performing a softening treatment during the course of the cold working. Note that the aforementioned "(total) reduction of area" refers to a value that, when the cross-sectional area of the steel material before the first cold working is denoted by "$S_0$" and the cross-sectional area of the steel material after performing the final cold working is denoted by "$S_f$", is represented by:

$$\{(S_0-S_f)/S_0\}\times 100.$$

(e) Aging Treatment Steps

The steel material that underwent the aforementioned cold working is subjected to an aging treatment in which the steel material is held for 0.5 to 2 hours at 600 to 750° C. so that a YS of 758 MPa or more can be stably secured. If the aging treatment temperature is less than 600° C., or if the aging treatment time period is less than 0.5 hours, in some cases the precipitation effect of carbides and/or carbo-nitrides of V, Ti and Nb that are effective for strengthening is insufficient, and a high strength that is a YS of 758 MPa or more cannot be secured. On the other hand, if the aging treatment temperature is more than 750° C. or if the aging treatment time period is more than two hours, in some cases an over-aged state is entered and a high strength of a YS of 758 MPa or more cannot be secured. Furthermore, if the aging treatment time period is more than two hours, it is disadvantageous from the viewpoint of productivity, and the energy cost also increases. The term "aging treatment temperature" with respect to this process also refers to the temperature at the surface of the steel material.

(f) Cooling Step

After performing the aging treatment, the steel material is cooled to a temperature of not more than 100° C. At this time, preferably quenching is performed in a similar manner as in step (c).

(5-2) Production Method in Case of Performing Solid Solution Heat Treatment Directly after Hot Working Step (g) Hot Working Step The aforementioned steel material is heated to 900 to 1200° C., and thereafter is finished into a predetermined shape at a temperature of 800° C. or more. If the temperature heating of the steel material is lower than 900° C., the deformation resistance during hot working becomes larger and the load applied to the processing equipment increases, and processing defects such as flaws or cracks may occur. On the other hand, if the heating temperature is higher than 1200° C., it may cause high-temperature intergranular cracking or a reduction in ductility. Therefore, the heating temperature of the steel material during the hot working step is set in the range of 900 to 1200° C. The heating temperature is preferably set to not less than 1000° C., and is preferably set to not more than 1150° C.

If the finishing temperature of the hot working is lower than 800° C., precipitates such as carbides arise, and in some cases, in a so-called "direct solid solution heat treatment" that is the next process, the precipitates do not adequately dissolve, and remain in the austenite matrix. The finishing temperature of hot working is preferably set to 1000° C. or more, and is preferably set to 1150° C. or less. The terms "heating temperature" and "finishing temperature" in this process refer to the respective temperatures at the surface of the steel material. Note that, although also depending on the size or shape of the product, the holding time in the aforementioned heating temperature range is preferably set to between 10 and 180 minutes, and more preferably is set to between 20 and 120 minutes.

(h) Solid Solution Heat Treatment Step

By subjecting the steel material that was finished into a predetermined shape at a temperature of 1000° C. or more to quenching in a successive manner immediately thereafter, precipitates such as carbides can be kept in a state in which the precipitates are adequately dissolved in the austenite matrix. Note that, similarly to the step (c), the quenching in this process may be performed at a cooling rate such that precipitation of carbides and intermetallic compounds can be prevented during cooling such as water cooling, oil cooling or mist cooling, and which is a cooling rate that does not produce thermal strain. Although also depending on the size or shape of the product, the aforementioned quenching is preferably performed within 180 seconds after the steel material is finished by the hot working.

(i) Cold Working Step

Cold working with a reduction of area of 5 to 20% is performed to secure nucleation sites of carbides and carbonitrides with respect to the steel material that was quenched in the so-called "direct solid solution heat treatment" of step (h). If the reduction of area is less than 5%, in some cases a high strength that is a YS of 758 MPa or more cannot be secured. On the other hand, if the reduction of area is more than 20%, in some cases there are constraints in terms of the equipment or product size or the like. The reduction of area is preferably 18% or less.

Similarly to the aforementioned step (d), as long as the reduction of area is from 5 to 20%, the number of times cold working is performed is not particularly limited, and may be a single time or multiple times. However, in a case of performing cold working multiple times, while naturally the cold working has to be performed in a manner that ensures that the total reduction of area is not more than 20%, it is necessary to perform the cold working without performing a softening treatment during the course of the cold working.

(j) Aging Treatment Steps

The steel material that underwent the aforementioned cold working is subjected to an aging treatment in which the steel material is held for 0.5 to 2 hours at 600 to 750° C. so that a YS of 758 MPa or more can be stably secured. If the aging treatment temperature is less than 600° C., or if the aging treatment time period is less than 0.5 hours, in some cases the precipitation effect of carbides and/or carbo-nitrides of V, Ti and Nb that are effective for strengthening is insufficient, and a high strength that is a YS of 758 MPa or more cannot be secured. On the other hand, if the aging treatment temperature is more than 750° C. or if the aging treatment time period is more than two hours, in some cases an over-aged state is entered and a high strength that is a YS of 758 MPa or more cannot be secured. Furthermore, if the aging treatment time period is more than two hours, it is disadvantageous from the viewpoint of productivity, and the energy cost also increases. The term "aging treatment temperature" with respect to this process also refers to the temperature at the surface of the steel material.

(k) Cooling Step

After performing the aging treatment, the steel material is cooled to a temperature of not more than 100° C. At this time, preferably quenching is performed in a similar manner as in step (c).

Note that the steel material that underwent the solid solution heat treatment in step (c) or step (h) may, as necessary, may be subjected to mechanical working such as cutting or peeling prior to cold working. Further, when performing cold working, preferably a lubrication treatment is performed by an appropriate method.

Hereunder, the present invention is described specifically by way of examples, although the present invention is not limited to the following examples.

EXAMPLES

Steels 1 to 24 having the chemical compositions given in Table 1 were melted using a 50 kg vacuum furnace, and ingots obtained by casting the molten steels into molds were heated at 1150° C. for 180 minutes, and thereafter formed into a plate material having a thickness 40 mm by hot forging.

Steels numbers 1 to 21 in Table 1 are steels whose chemical compositions were within the range defined by the present invention. On the other hand, steels numbers 22 to 24 are steels whose chemical compositions deviated from the conditions defined by the present invention.

TABLE 1

| Steel | Chemical composition (in mass %, balance: Fe and impurities) | | | | | | | | | | | Left hand value |
|---|---|---|---|---|---|---|---|---|---|---|---|---|
| No. | C | Si | Mn | P | S | Al | N | V | Ti | Nb | Others | of equation (i)† |
| 1 | 0.31 | 0.30 | 20.14 | 0.010 | 0.006 | 0.030 | 0.046 | 2.11 | — | — | Cu: 0.11, Ni: 0.19 | 2.11 |
| 2 | 0.40 | 0.30 | 20.12 | 0.010 | 0.005 | 0.026 | 0.049 | 2.13 | — | — | Cu: 0.10, Ni: 0.20 | 2.13 |
| 3 | 0.40 | 0.26 | 30.31 | 0.010 | 0.007 | 0.025 | 0.071 | 2.15 | — | — | Cu: 0.10, Ni: 0.20 | 2.15 |
| 4 | 0.49 | 0.28 | 20.37 | 0.010 | 0.006 | 0.022 | 0.058 | 2.10 | — | — | Cu: 0.10, Ni: 0.19 | 2.10 |
| 5 | 0.50 | 0.27 | 20.15 | 0.009 | 0.005 | 0.025 | 0.048 | 2.30 | — | — | — | 2.30 |
| 6 | 0.58 | 0.28 | 20.20 | 0.010 | 0.006 | 0.023 | 0.068 | 2.10 | — | — | Cu: 0.10, Ni: 0.20 | 2.10 |
| 7 | 0.81 | 0.28 | 20.31 | 0.010 | 0.006 | 0.020 | 0.066 | 2.15 | — | — | — | 2.15 |
| 8 | 0.90 | 0.27 | 20.05 | 0.010 | 0.007 | 0.024 | 0.058 | 2.11 | — | — | — | 2.11 |
| 9 | 0.50 | 0.29 | 19.95 | 0.011 | 0.004 | 0.028 | 0.053 | 2.12 | — | — | Cr: 1.01 | 2.12 |
| 10 | 0.51 | 0.26 | 20.24 | 0.008 | 0.006 | 0.026 | 0.049 | 2.11 | — | — | Mo: 1.00 | 2.11 |
| 11 | 0.49 | 0.31 | 20.21 | 0.010 | 0.005 | 0.021 | 0.056 | 2.15 | — | — | Cu: 0.30 | 2.15 |
| 12 | 0.49 | 0.33 | 19.98 | 0.010 | 0.006 | 0.033 | 0.052 | 1.67 | 0.502 | — | Ni: 0.11 | 2.17 |
| 13 | 0.48 | 0.27 | 19.89 | 0.009 | 0.005 | 0.030 | 0.064 | 2.01 | — | 0.100 | — | 2.11 |
| 14 | 0.50 | 0.33 | 20.14 | 0.012 | 0.004 | 0.026 | 0.052 | 2.02 | 0.100 | — | — | 2.12 |
| 15 | 0.49 | 0.29 | 19.99 | 0.008 | 0.006 | 0.032 | 0.042 | 2.89 | — | — | B: 0.0010 | 2.89 |
| 16 | 0.50 | 0.30 | 20.33 | 0.010 | 0.007 | 0.029 | 0.053 | 2.70 | — | — | Zr: 0.32 | 2.70 |
| 17 | 0.50 | 0.28 | 20.16 | 0.010 | 0.005 | 0.028 | 0.060 | 2.50 | — | — | Ta: 0.23 | 2.50 |
| 18 | 0.50 | 0.28 | 20.22 | 0.009 | 0.005 | 0.035 | 0.042 | 2.11 | — | — | Ca: 0.0020 | 2.11 |
| 19 | 0.51 | 0.27 | 19.78 | 0.009 | 0.004 | 0.025 | 0.056 | 2.11 | — | — | Mg: 0.0020 | 2.11 |
| 20 | 0.50 | 0.32 | 21.08 | 0.011 | 0.006 | 0.021 | 0.049 | — | 1.080 | 1.020 | Cu: 0.12, Ni: 0.21 | 2.10 |
| 21 | 0.51 | 0.30 | 20.58 | 0.008 | 0.006 | 0.032 | 0.067 | 0.49 | 1.001 | 0.980 | — | 2.47 |
| 22 | 0.20* | 0.30 | 20.15 | 0.010 | 0.005 | 0.026 | 0.053 | 2.10 | — | — | Cu: 0.10, Ni: 0.20 | 2.10 |
| 23 | 0.50 | 0.27 | 20.05 | 0.009 | 0.005 | 0.025 | 0.005 | 1.02 | — | — | — | 1.02* |
| 24 | 0.40 | 0.28 | 10.01* | 0.010 | 0.007 | 0.026 | 0.042 | 2.11 | — | — | — | 2.11 |

*indicates that conditions do not satisfy those defined by the present invention.

†V + Ti + Nb >2.0 . . . (i)

Each plate material having a thickness of 40 mm obtained as described above was hot-rolled to form a plate material having a thickness of 20 mm under the conditions shown in Table 2. Thereafter, with respect to Test Nos. 1 to 10, 13 to 15 and 18 to 52, after being cooled to room temperature after finish rolling, the plate material was reheated and subjected to a solid solution heat treatment. Further, with respect to Test Nos. 11, 12, 16 and 17, a direct solid solution heat treatment was performed after finish rolling. All of these plate materials were thereafter further subjected to cold rolling and aging treatment under the conditions shown in Table 2 to obtain the test materials.

cooling (WQ) was adopted as the quenching after the solid solution heat treatment. Water cooling was also adopted as the quenching after the direct solid solution heat treatment. Further, the aforementioned cold rolling was performed after applying a solid lubricant. In addition, as the cooling after performing the aging treatment, water cooling was adopted in any case.

TABLE 2

| | | Hot rolling | | | Solid solution heat treatment | | Cold rolling | | Aging treatment | |
|---|---|---|---|---|---|---|---|---|---|---|
| Test No. | Steel No. | Heating temperature (° C.) | Holding time (min) | Finishing temperature (° C.) | Temperature (° C.) | Holding time (min) | Number of passes | Reduction of area (%) | Temperature (° C.) | Holding time (hour) |
| 1 | 1 | 1150 | 30 | 1000 | 1150 | 30 | 1 | 5 | 600 | 2 |
| 2 | 2 | 1150 | 30 | 1000 | 1150 | 30 | 1 | 5 | 600 | 2 |
| 3 | 3 | 1150 | 30 | 1000 | 1150 | 30 | 1 | 5 | 700 | 0.5 |
| 4 | 3 | 1150 | 30 | 1000 | 1150 | 30 | 1 | 10 | 700 | 1 |
| 5 | 3 | 1150 | 30 | 1000 | 1150 | 30 | 1 | 18 | 700 | 1 |
| 6 | 4 | 1150 | 30 | 1000 | 1150 | 30 | 1 | 5 | 700 | 1 |
| 7 | 4 | 1150 | 30 | 1000 | 1150 | 30 | 1 | 10 | 700 | 1 |
| 8 | 4 | 1150 | 30 | 1000 | 1150 | 30 | 1 | 18 | 700 | 1 |
| 9 | 5 | 1150 | 30 | 1000 | 1150 | 30 | 1 | 5 | 700 | 1 |
| 10 | 5 | 1150 | 30 | 1000 | 1150 | 30 | 1 | 10 | 700 | 0.5 |
| 11 | 5 | 1150 | 30 | 1000 | Direct WQ after 30 s | | 1 | 5 | 700 | 1 |
| 12 | 5 | 1150 | 30 | 1000 | Direct WQ after 30 s | | 1 | 10 | 700 | 1 |
| 13 | 6 | 1150 | 30 | 1000 | 1150 | 30 | 1 | 5 | 700 | 1 |
| 14 | 6 | 1150 | 30 | 1000 | 1150 | 30 | 1 | 10 | 700 | 1 |
| 15 | 6 | 1150 | 30 | 1000 | 1150 | 30 | 1 | 20 | 700 | 0.5 |
| 16 | 6 | 1150 | 30 | 1000 | Direct WQ after 30 s | | 1 | 5 | 700 | 1 |
| 17 | 6 | 1150 | 30 | 1000 | Direct WQ after 30 s | | 1 | 10 | 700 | 1 |
| 18 | 7 | 1150 | 30 | 1000 | 1200 | 30 | 1 | 5 | 700 | 1 |
| 19 | 7 | 1150 | 30 | 1000 | 1200 | 30 | 1 | 10 | 700 | 1 |
| 20 | 7 | 1150 | 30 | 1000 | 1000 | 60 | 1 | 5 | 700 | 1 |
| 21 | 7 | 1150 | 30 | 1000 | 1000 | 60 | 1 | 10 | 700 | 1 |
| 22 | 8 | 1150 | 30 | 1000 | 1100 | 30 | 1 | 5 | 700 | 1 |
| 23 | 8 | 1150 | 30 | 1000 | 1100 | 30 | 1 | 10 | 700 | 1 |
| 24 | 9 | 1150 | 30 | 1000 | 1150 | 45 | 1 | 15 | 700 | 1.5 |
| 25 | 10 | 1150 | 30 | 1000 | 1150 | 45 | 1 | 5 | 700 | 1.5 |
| 26 | 11 | 1150 | 30 | 1000 | 1150 | 45 | 1 | 10 | 700 | 1 |
| 27 | 12 | 1150 | 30 | 1000 | 1150 | 45 | 1 | 10 | 700 | 1 |
| 28 | 13 | 1150 | 30 | 1000 | 1150 | 30 | 1 | 17 | 620 | 1 |
| 29 | 14 | 1150 | 30 | 1000 | 1150 | 30 | 1 | 17 | 620 | 1 |
| 30 | 15 | 1150 | 30 | 1000 | 1150 | 30 | 1 | 15 | 680 | 0.5 |
| 31 | 16 | 1150 | 30 | 1000 | 1150 | 30 | 1 | 15 | 680 | 0.5 |
| 32 | 17 | 1150 | 30 | 1000 | 1150 | 30 | 1 | 15 | 680 | 1 |
| 33 | 18 | 1150 | 30 | 1000 | 1150 | 30 | 1 | 10 | 750 | 0.5 |
| 34 | 19 | 1150 | 30 | 1000 | 1150 | 30 | 1 | 10 | 750 | 0.5 |
| 35 | 20 | 1150 | 30 | 1000 | 1150 | 30 | 1 | 10 | 650 | 1 |
| 36 | 21 | 1150 | 30 | 1000 | 1150 | 30 | 1 | 10 | 650 | 1 |
| 37 | 1 | 1150 | 30 | 1000 | 1150 | 30 | 0 | 0# | 700 | 0.5 |
| 38 | 4 | 1150 | 30 | 1000 | 1150 | 30 | 0 | 0# | 600 | 1 |
| 39 | 4 | 1150 | 30 | 1000 | 1150 | 30 | 1 | 5 | —# | —# |
| 40 | 4 | 1150 | 30 | 1000 | 1150 | 30 | 1 | 10 | —# | —# |
| 41 | 4 | 1150 | 30 | 1000 | 1150 | 30 | 1 | 18 | —# | —# |
| 42 | 4 | 1150 | 30 | 1000 | 1150 | 30 | 1 | 10 | 700 | 5# |
| 43 | 6 | 1150 | 30 | 1000 | 1150 | 30 | 1 | 5 | —# | —# |
| 44 | 6 | 1150 | 30 | 1000 | 1150 | 30 | 1 | 10 | —# | —# |
| 45 | 6 | 1150 | 30 | 1000 | 1150 | 30 | 1 | 10 | 500# | 1 |
| 46 | 6 | 1150 | 30 | 1000 | 1150 | 30 | 0 | 0# | 700 | 8# |
| 47 | 22* | 1150 | 30 | 1000 | 1150 | 30 | 1 | 5 | 700 | 1 |
| 48 | 22* | 1150 | 30 | 1000 | 1150 | 30 | 1 | 10 | 700 | 1 |
| 49 | 23* | 1150 | 30 | 1000 | 1150 | 30 | 0 | 0# | 700 | 1 |
| 50 | 23* | 1150 | 30 | 1000 | 1150 | 30 | 1 | 5 | 700 | 1 |
| 51 | 23* | 1150 | 30 | 1000 | 1150 | 30 | 1 | 10 | 700 | 1 |
| 52 | 24* | 1150 | 30 | 1000 | 1150 | 30 | 1 | 5 | 700 | 1 |
| 53 | 24* | 1150 | 30 | 1000 | 1150 | 30 | 1 | 10 | 700 | 1 |

*indicates that conditions do not satisfy those defined by the present invention.
#indicates that production conditions fall out the preferable conditions defined by the present invention.

Note that, in the case of reheating and performing a solid solution heat treatment, the cooling to room temperature after being finished by hot rolling was carried out by allowing cooling in atmospheric air in any case, while water First, the steel micro-structure of the matrix of each of the aforementioned test materials was examined. Specifically, the volume ratio of a bcc structure phase was measured using a ferrite meter (model number: FE8e3) manufactured by Helmut Fischer. As a result, a bcc structure phase was not detected in Test Nos. 1 to 51. On the other hand, a bcc structure phase was recognized in Test No. 52 and Test No. 53.

Next, a thin film having a thickness of 100 nm was prepared from a center portion in the thickness direction of each test material, the relevant thin film was observed using a TEM, and the number of precipitates having a circle-equivalent diameter in the range of 5 to 30 nm and the number of precipitates having a circle-equivalent diameter of more than 100 nm that were included in a visual field of 1 μm square were counted, respectively. Note that the number of precipitates was counted in three visual fields, and the average value thereof was calculated.

Further, a round-bar tensile test specimen having a parallel part with a diameter of 4 mm in the rolling direction (longitudinal direction) was cut out from a center portion in the thickness direction of each test material, and a tensile test was conducted in atmospheric air at room temperature, and the YS was determined.

In addition, to evaluate the SSC resistance, a DCB test was performed based on "Method D" described in NACE TM0177-2005, and the $K_{ISSC}$ values were calculated. The specific procedures were as follows.

Figure 2:
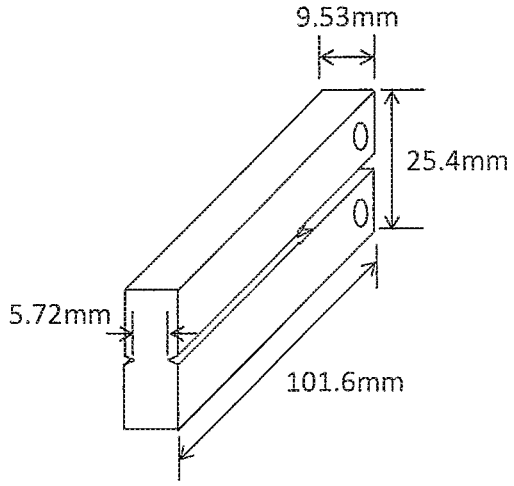
FIG. 2 is a view that schematically illustrates the shape of a DCB test specimen used in the Examples.
Figure 3:
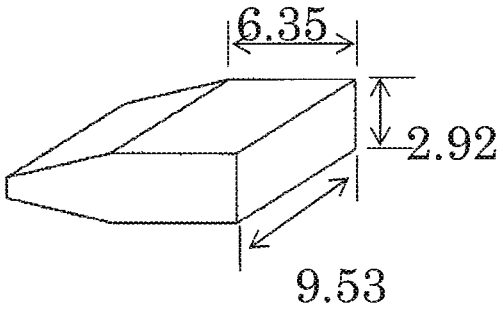
FIG. 3 is a view illustrating the shape of a wedge used in a DCB test in the Examples. Note that the numerical values in the drawing show the dimensions (unit: mm).

First, a DCB test specimen having a notch and a hole as illustrated in FIG. 2 in the rolling direction (longitudinal direction) and a wedge having a thickness of 2.92 mm as illustrated in FIG. 3 were extracted from a center portion in the thickness direction of each test material. Next, the test specimen that was in a state in which the wedge was driven into the aforementioned notch was enclosed in an autoclave, and thereafter Solution A (5% NaCl+0.5% $CH_3COOH$ aqueous solution; concentration is mass %) defined by NACE TM0177-2005 was degassed and injected into the autoclave. Next, hydrogen sulfide gas at 1 atm was blown into the autoclave to agitate the aforementioned liquid phase, and the hydrogen sulfide gas was saturated in the liquid phase. The autoclave was held for 336 hours at 24° C. while agitating the liquid phase, and thereafter the gas was replaced with nitrogen gas and the test specimens were taken out.

Thereafter, a pin was inserted into the aforementioned hole of each test specimen that had been taken out and the notch was opened with a tensile testing machine, and an equilibrium wedge load was measured. In addition, in a state in which the test specimen had been cooled to the temperature of liquid nitrogen, a stake was inserted into the notch, and the test specimen was forcedly ruptured by hitting the stake with a hammer, and thereafter a crack propagation length during immersion in the liquid phase was measured visually by measurement using a vernier calipers. Finally, the $K_{ISSC}$ value was calculated based on the aforementioned equilibrium wedge load and the aforementioned crack propagation length.

The number density of precipitates, the YS and $K_{ISSC}$ values that were determined as described above are shown together in Table 3. Further, FIG. 1 shows a comparison of $K_{ISSC}$ values obtained by the aforementioned DCB test in a high-strength region in which the YS was 758 MPa or more with respect to high-Mn steel material of "Inventive example" of Test Nos. 1 to 36 in which the crystal structure was an fcc structure and a conventional type of low-alloy steel material in which the crystal structure was a bcc structure (low-alloy steel material obtained by subjecting a 0.27% C-1% Cr-0.7% Mo low alloy steel to a quenching and tempering treatment (denoted by "QT" in the drawing)).

TABLE 3

| Test No. | Steel No. | Number density of precipitates of 5~30 nm (/μm²) | Number density of precipitates of >30~100 nm (/μm²) | Number density of precipitates of >100 nm (/μm²) | Yield stress (MPa) | $K_{ISSC}$ (MPa · m$^{0.5}$) | |
|---|---|---|---|---|---|---|---|
| 1 | 1 | 285 | 0 | 0 | 765 | 35.8 | Inventive example |
| 2 | 2 | 293 | 0 | 0 | 760 | 34.5 | |
| 3 | 3 | 313 | 0 | 0 | 772 | 35.2 | |
| 4 | 3 | 444 | 0 | 0 | 786 | 35.8 | |
| 5 | 3 | 547 | 0 | 0 | 855 | 35.4 | |
| 6 | 4 | 370 | 0 | 0 | 793 | 35.9 | |
| 7 | 4 | 460 | 0 | 0 | 795 | 36.0 | |
| 8 | 4 | 540 | 0 | 0 | 862 | 34.3 | |
| 9 | 5 | 367 | 0 | 0 | 772 | 35.8 | |
| 10 | 5 | 380 | 0 | 0 | 779 | 35.5 | |
| 11 | 5 | 350 | 0 | 0 | 761 | 34.8 | |
| 12 | 5 | 421 | 0 | 0 | 773 | 34.4 | |
| 13 | 6 | 395 | 0 | 0 | 800 | 35.7 | |
| 14 | 6 | 470 | 0 | 0 | 807 | 35.8 | |
| 15 | 6 | 490 | 0 | 0 | 876 | 34.2 | |
| 16 | 6 | 368 | 0 | 0 | 786 | 34.8 | |
| 17 | 6 | 446 | 0 | 0 | 800 | 34.8 | |
| 18 | 7 | 395 | 0 | 0 | 855 | 34.2 | |
| 19 | 7 | 486 | 0 | 0 | 889 | 34.5 | |
| 20 | 7 | 379 | 1 | 1 | 786 | 34.9 | |
| 21 | 7 | 453 | 1 | 1 | 848 | 35.2 | |
| 22 | 8 | 388 | 0 | 0 | 892 | 35.7 | |
| 23 | 8 | 468 | 0 | 0 | 421 | 35.3 | |
| 24 | 9 | 513 | 3 | 2 | 816 | 35.3 | |
| 25 | 10 | 383 | 1 | 1 | 794 | 35.2 | |
| 26 | 11 | 452 | 0 | 0 | 783 | 35.6 | |
| 27 | 12 | 448 | 0 | 0 | 787 | 35.4 | |
| 28 | 13 | 479 | 0 | 0 | 802 | 34.6 | |
| 29 | 14 | 462 | 0 | 0 | 796 | 35.7 | |
| 30 | 15 | 374 | 0 | 0 | 822 | 34.7 | |
| 31 | 16 | 357 | 0 | 0 | 820 | 35.0 | |
| 32 | 17 | 445 | 0 | 0 | 830 | 35.9 | |
| 33 | 18 | 456 | 0 | 0 | 791 | 34.1 | |

TABLE 3-continued

| Test No. | Steel No. | Number density of precipitates of 5~30 nm (/μm²) | Number density of precipitates of >30~100 nm (/μm²) | Number density of precipitates of >100 nm (/μm²) | Yield stress (MPa) | $K_{ISSC}$ (MPa · m$^{0.5}$) | |
|---|---|---|---|---|---|---|---|
| 34 | 19 | 446 | 0 | 0 | 779 | 34.3 | |
| 35 | 20 | 331 | 0 | 0 | 765 | 35.7 | |
| 36 | 21 | 341 | 0 | 0 | 787 | 36.0 | |
| 37 | 1 | 21* | 0 | 0 | 703* | 34.6 | Comparative example |
| 38 | 4 | 19* | 0 | 0 | 696* | 35.0 | |
| 39 | 4 | 0* | 0 | 0 | 469* | 34.1 | |
| 40 | 4 | 0* | 0 | 0 | 558* | 35.4 | |
| 41 | 4 | 0* | 0 | 0 | 674* | 35.5 | |
| 42 | 4 | 42* | 15 | 13* | 669* | 34.7 | |
| 43 | 6 | 0* | 0 | 0 | 510* | 35.2 | |
| 44 | 6 | 0* | 0 | 0 | 614* | 35.0 | |
| 45 | 6 | 45* | 0 | 0 | 602* | 34.4 | |
| 46 | 6 | 27* | 14 | 16* | 724* | 34.6 | |
| 47 | 22* | 37* | 0 | 0 | 648* | 34.8 | |
| 48 | 22* | 46* | 0 | 0 | 655* | 35.1 | |
| 49 | 23* | 25* | 0 | 0 | 694* | 35.3 | |
| 50 | 23* | 35* | 0 | 0 | 696* | 34.6 | |
| 51 | 23* | 47* | 0 | 0 | 710* | 34.3 | |
| 52 | 24* | 354 | 0 | 0 | 793 | 25.4* | |
| 53 | 24* | 438 | 0 | 0 | 807 | 25.2* | |

*indicates that conditions do not satisfy those defined by the present invention.

It is evident from Table 3 that Test Nos. 1 to 36 that are inventive examples of the present invention have a YS of 758 MPa or more and have excellent SSC resistance as demonstrated by an $K_{ISSC}$ value of 33.7 MPa·m$^{0.5}$ or more obtained in the DCB test.

In contrast, in Test Nos. 37 to 53 that are comparative examples, either a high strength of a YS of 758 MPa or more was not obtained, or an SSC resistance of a $K_{ISSC}$ of 33.7 MPa·m$^{0.5}$ or more was not obtained in the DCB test.

In other words, as shown in Test Nos. 37 to 46, even when steel having a chemical composition that satisfies the conditions defined by the present invention is used, a high strength of a YS of 758 MPa or more is not obtained if the production conditions are not preferable.

Specifically, in Test Nos. 37 and 38 in which cold working was not performed prior to an aging treatment, even when the aging treatment was performed thereafter under suitable conditions, fine precipitates were not sufficiently formed and therefore the required strength was not obtained. Further, in Test No. 46 in which, similarly, cold working was not performed prior to an aging treatment, even though aging treatment was performed for a long time period thereafter, this resulted in the formation of coarse precipitates and, on the contrary, resulted in a decrease in strength.

In Test Nos. 39 to 41, 43 and 44 in which an aging treatment was not performed, precipitates were not formed at all, and consequently the strength was lowered. Further, in Test No. 42, because the aging treatment time period was too long, precipitates coarsened and consequently the strength was lowered. In addition, in Test No. 45, because the aging treatment temperature was too low, fine precipitates were not sufficiently formed and the required strength was not obtained.

Further, in a case where the chemical composition of the used steel deviated from the conditions defined by the present invention, as shown in Test Nos. 47 to 53, irrespective of whether the production conditions satisfied or did not satisfy the conditions defined by the present invention, either a high strength of a YS of 758 MPa or more was not obtained or an SSC resistance having a $K_{ISSC}$ value of 33.7 MPa·m$^{0.5}$ or more was not obtained in the DCB test.

Specifically, in Test Nos. 47 and 48 that used steel no. 22 in which the C content was lower than the defined value and in Test Nos. 49 to 51 that used steel no. 23 in which the total content of V, Ti and Nb was lower than the defined value, fine precipitates were not sufficiently formed and the required strength was not obtained. Further, in Test Nos. 52 and 53 that used steel no. 24 in which the Mn content was lower than the defined value, the $K_{ISSC}$ values obtained by the DCB test were inferior, which was attributable to mixing of a bcc structure phase.

Next, using the plate materials prepared in the aforementioned Test Nos. 1 to 36 for which favorable SSC resistance was obtained in the DCB test, the SSC resistance was investigated by performing a constant load test. Specifically, a plate-shaped smooth test specimen was sampled in the rolling direction (longitudinal direction) from the center portion in the thickness direction of each plate material that had undergone the aging treatment, and a stress corresponding to 90% of YS was applied to one surface of the test specimen by a four-point bending method. Thereafter, the test specimen was immersed in Solution A defined in NACE TM0177-2005 which was saturated with hydrogen sulfide gas at 1 atm as a test solution, and was held at 24° C. for 336 hours, after which it was determined whether or not the test specimen had ruptured. As a result, it was confirmed that rupturing did not occur in any of the test materials.

In addition, plate-shaped smooth test specimens were sampled in a similar manner as described above from the plate materials prepared in Test Nos. 1 to 36, the test specimens were immersed for 336 hours at 24° C. in Solution A defined in NACE TM0177-2005 which was saturated with hydrogen sulfide gas at 1 atm, and the corrosion loss was determined. As a result, it was confirmed that the amount of corrosion loss was small, and the test materials were excellent in general corrosion resistance.

INDUSTRIAL APPLICABILITY

Because the high-strength steel material of the present invention has a yield stress of 758 MPa or more and has a $K_{ISSC}$ value according to a DCB test of 33.7 MPa·m$^{0.5}$ or more, the high-strength steel material can be favorably used for oil country tubular goods and the like that are to be used in a sour environment. Further, the aforementioned high-strength steel material can be obtained by the production method of the present invention.

The invention claimed is:

1. A high-strength steel material having a chemical composition consisting of, by mass %, C: 0.30 or more and less than 0.60%,
Si: 0.05 to 0.33%,
Mn: 16.0 to 35.0%,
P: 0.030% or less,
S: 0.030% or less,
Al: 0.003 to 0.06%,
N: 0.1% or less,
V: 0 to 3.0%,
Ti: 0 to 1.5%,
Nb: 0 to 1.5%,
Cr: 0 to 5.0%,
Mo: 0 to 3.0%,
Cu: 0 to 1.0%,
Ni: 0 to 1.0%,
B: 0 to 0.02%,
Zr: 0 to 0.5%,
Ta: 0 to 0.5%,
Ca: 0 to 0.005%,
Mg: 0 to 0.005%, and
the balance: Fe and impurities,
and satisfying formula (i) hereunder,
wherein:

a number density of carbides and/or carbo-nitrides having a circle-equivalent diameter of 5 nm to 30 nm precipitating in the steel is 50 to 700/$\mu m^2$, and a number density of carbides and/or carbo-nitrides having a circle-equivalent diameter of more than 100 nm precipitating in the steel is less than 10/$\mu m^2$, a yield stress is 758 MPa or more, and a $K_{ISSC}$ value obtained in a DCB test is 33.7 MPa·$m^{0.5}$ or more;

$$V+Ti+Nb>2.0 \quad (i)$$

where, V, Ti and Nb in formula (i) above represent a content (mass %) of the respective elements contained in the steel, with the value thereof being set to zero in a case where the corresponding element is not contained.

2. The high-strength steel material according to claim 1, wherein the chemical composition contains, by mass %, one or more elements selected from the group consisting of V: 0.1 to 3.0%,
Ti: 0.003 to 1.5%,
Nb: 0.003 to 1.5%,
Cr: 0.1 to 5.0%,
Mo: 0.5 to 3.0%,
Cu: 0.1 to 1.0%,
Ni: 0.1 to 1.0%,
B: 0.0001 to 0.02%,
Zr: 0.005 to 0.5%,
Ta: 0.005 to 0.5%,
Ca: 0.0003 to 0.005%, and
Mg: 0.0003 to 0.005%.

3. A method for producing a high-strength steel material according to claim 1, the method comprising performing steps of (a) to (f) described hereunder in sequence on a steel material having a chemical composition described in claim 1:

(a) a hot working step of heating to a temperature in a range of 900° C. to 1200° C., and thereafter finishing into a predetermined shape;
(b) a cooling step of cooling to a temperature of 100° C. or less;
(c) a solid solution heat treatment step of heating to a temperature in a range of 800° C. to 1200° C. and holding at the temperature for not less than 10 minutes, and thereafter quenching;
(d) a cold working step of performing working with a reduction of area in a range of 5% to 20%;
(e) an aging treatment steps of holding at a temperature of 600° C. to 750° C. for 0.5 hours to 2 hours; and
(f) a cooling step of cooling to a temperature of 100° C. or less.

4. A method for producing a high-strength steel material according to claim 1, the method comprising performing steps of (g) to (k) described hereunder in sequence on a steel material having a chemical composition described in claim 1:

(g) a hot working step of heating to a temperature in a range of 900° C. to 1200° C., and thereafter finishing into a predetermined shape at a temperature of 800° C. or more;
(h) a solid solution heat treatment step of quenching immediately following the step of (g);
(i) a cold working step of performing working with a reduction of area in a range of 5% to 20%;
(j) an aging treatment steps of holding at a temperature of 600° C. to 750° C. for 0.5 hours to 2 hours; and
(k) a cooling step of cooling to a temperature of 100° C. or less.

5. A method for producing a high-strength steel material according to claim 2, the method comprising performing steps of (a) to (f) described hereunder in sequence on a steel material having a chemical composition described in claim 2:

(a) a hot working step of heating to a temperature in a range of 900° C. to 1200° C., and thereafter finishing into a predetermined shape;
(b) a cooling step of cooling to a temperature of 100° C. or less;
(c) a solid solution heat treatment step of heating to a temperature in a range of 800° C. to 1200° C. and holding at the temperature for not less than 10 minutes, and thereafter quenching;
(d) a cold working step of performing working with a reduction of area in a range of 5% to 20%;
(e) an aging treatment steps of holding at a temperature of 600° C. to 750° C. for 0.5 hours to 2 hours; and
(f) a cooling step of cooling to a temperature of 100° C. or less.

6. A method for producing a high-strength steel material according to claim 2, the method comprising performing steps of (g) to (k) described hereunder in sequence on a steel material having a chemical composition described in claim 2:

(g) a hot working step of heating to a temperature in a range of 900° C. to 1200° C., and thereafter finishing into a predetermined shape at a temperature of 800° C. or more;
(h) a solid solution heat treatment step of quenching immediately following the step of (g);
(i) a cold working step of performing working with a reduction of area in a range of 5% to 20%;

(j) an aging treatment steps of holding at a temperature of 600° C. to 750° C. for 0.5 hours to 2 hours; and (k) a cooling step of cooling to a temperature of 100° C. or less.

* * * * *